United States Patent [19]

Flamme et al.

[11] 4,307,600

[45] Dec. 29, 1981

[54] FORMING PRESS WITH AT LEAST ONE TOOL COUPLE

[75] Inventors: Walter Flamme, Wegberg-Beeckerheide; Oskar Rahn, Kempen, both of Fed. Rep. of Germany

[73] Assignee: Peltzer & Ehlers GmbH & Co., Krefeld, Fed. Rep. of Germany

[21] Appl. No.: 100,272

[22] Filed: Dec. 4, 1979

[51] Int. Cl.[3] ..... B21J 13/00

[52] U.S. Cl. ..... 72/448; 10/11 R; 10/26; 72/473

[58] Field of Search ..... 72/473, 448, 446, 470, 72/472, 358, 352; 10/26, 11 A, 11 R, 12 R, 15

[56] References Cited

U.S. PATENT DOCUMENTS

| | | | |
|---|---|---|---|
| 2,415,931 | 2/1947 | Bratz | 72/448 |
| 3,247,533 | 4/1966 | Phipard | 10/26 |
| 3,264,853 | 8/1966 | Huber | 10/11 R |
| 3,299,453 | 1/1967 | Meerendonk | 10/26 |

FOREIGN PATENT DOCUMENTS

| | | | |
|---|---|---|---|
| 1011254 | 12/1954 | Fed. Rep. of Germany | 72/448 |

*Primary Examiner*—Gene P. Crosby
*Attorney, Agent, or Firm*—Shlesinger, Arkwright, Garvey & Dinsmore

[57] ABSTRACT

A forming press is disclosed having a press frame, a slidable press carriage, and at least one tool couple comprising a plunger and a matrix. A pressure member is movable in the direction of motion of the press carriage for bracing the plunger against the press carriage. A screw controlled adjustment means including a motor is mounted on the press frame for driving the screw of the adjustment means and thereby positioning the pressure member. A drive gear is mounted on the screw, and coupling means is provided for connecting the motor and the drive gear at a predetermined position of the press carriage.

8 Claims, 2 Drawing Figures

FORMING PRESS WITH AT LEAST ONE TOOL COUPLE

The application concerns a forming press with at least one tool couple comprising a plunger and a matrix, whereby each such plunger is braced against the sliding press carriage via a pressure piece which is slidable in the direction of motion of the sliding press carriage by means of an adjusting mechanism controllable by a screw.

Forming presses are known in which each press plunger on its back side is braced against a pressure piece which is slidable in the direction of motion of the sliding press carriage by means of an adjusting mechanism. This arrangement enables the positioning of the press plunger to be adapted to different workpieces.

Each of the adjusting mechanisms in such a system comprises a slidable adjusting wedge, which is slidable via a screw and against which the back side of a correspondingly wedge-shaped pressure piece is braced. The position of the pressure plate is changed by shifting the adjusting wedge perpendicularly to the axis of the press plunger.

In the setting process, the screws of the adjusting mechanism are turned by hand, after loosening the lock nuts, and thereafter are secured by retightening the lock nuts. This is a cumbersome and time-consuming procedure, particularly on multistage forming presses.

Accordingly, the problem underlying the invention is to substantially facilitate the adjusting of the plunger(s) in forming presses of the type initially described above.

This problem is solved according to the invention in that the adjusting mechanism is furnished with a motor for driving the screw. In this way the screw of each adjusting mechanism can be adjusted by remote control, with minimal interruption of the press operation.

In embodying the invention it is provided that the motor is mounted on the press frame and a coupling mechanism is provided for coupling the motor to a gear mounted on the screw, at one specific position of the sliding press carriage. This arrangement has the advantage that the moving mass of the sliding press carriage is kept low and the motor is not subjected to the impulses and vibrations of the sliding press carriage. The coupling mechanism may comprise a pinion connected to the motor, which pinion can be moved into the path of the sliding press carriage to position said pinion for engaging said gear mounted on the screw. The motion of the pinion can be accomplished by a control piston to which a pressure medium under pressure can be applied and which operates against the action of a spring. With the aid of this spring the pinion is held normally outside the path of the sliding press carriage, and only moved into the engaging position when the control piston is acted upon by the pressurized pressure medium. The assembly may be so devised that the pinion is attached to a bar interior to a drive sleeve, with said bar being connected to said drive sleeve via a spline such that the bar and drive sleeve cannot rotate relative to each other.

It is of practical value to dispose the coupling mechanism on the press frame such that the engaging position occurs at the rearward end of the excursion of the sliding press carriage, since this position is very easily reproducible.

According to another feature of the invention it is proposed that the screw be provided with a hydraulic collet for fixing the setting of the pressure piece. Like the motor, this collet may be remote-controlled, to that the screw can be released and fixed quickly and without trouble.

The motor for driving the screw is preferably a servo motor, according to the invention, since servo motors are particularly suited to the purpose.

Further, the invention provides that in the case of multiple tool pairs, and thus multiple press stages, an adjusting mechanism and a coupling mechanism are provided for each plunger, and the coupling mechanisms are coupled to each other and to the single motor by means of gears. Thus one motor is sufficient to adjust multuple pressure pieces.

The invention is illustrated in more detail in the drawings with the aid of an example embodiment.

FIG. 1 is a horizontal cross section through a tool pair 1 of a three stage forming press, with details of the press omitted here for the sake of clarity.

Figure 1:
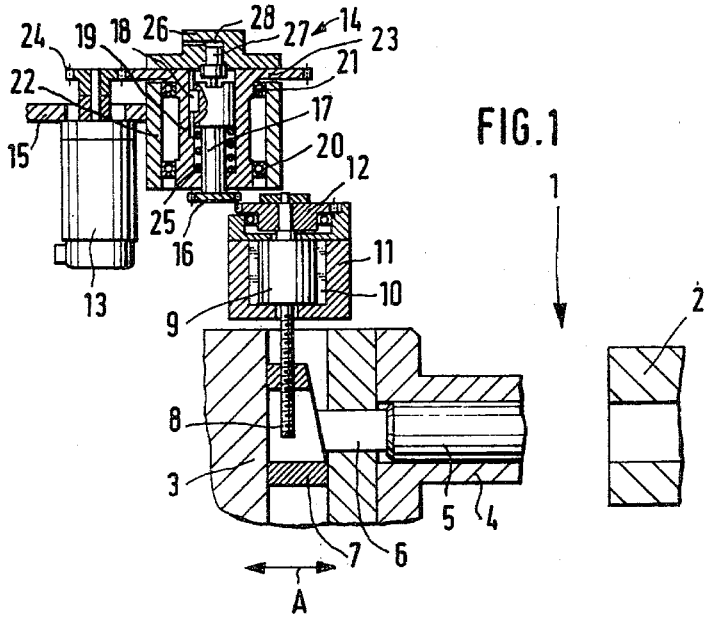
FIG. 1 is a horizontal cross section through one stage of the forming press.

Tool pair 1 comprises a fixed matrix 2 and a sliding press carriage 3 which moves back and forth in the direction of double arrow A. The end face of the sliding press carriage 3 has a plunger block 4 mounted on it for each stage, with each such plunger block having a press plunger 5 fitted into it.

Press plunger 5 is supported on its back side by a pressure piece 6 which is slidably guided in the sliding press carriage 3 in the direction of double arrow A.

The back side of pressure piece 6 is sloped and sits against a complementarily sloped surface of an adjusting wedge 7. This adjusting wedge 7 is slidably guided in sliding press carriage 3 perpendicularly to the axis of press plunger 5, whereby a sliding of the wedge produces a corresponding sliding of pressure piece 6 and press plunger 5, as a consequence of the (abovementioned) sloping surfaces.

The sliding of adjusting wedge 7 is produced by the rotation of a screw 8 which is pivotably mounted but otherwise fixed (i.e. as to translation and as to rotation about other than its longitudinal axis) on sliding press carriage 3. Screw 8 undergoes a transition to a cylindrically shaped part 9 at its end opposite to adjusting wedge 7. Part 9 has a collet 10 around it and a housing 11 which is connected to sliding press carriage 3. By applying hydraulic pressure to collet 10, part 9 and thus screw 8 can be fixed in a given position.

On the outer end of screw 8 a spur gear 12 is mounted, via which screw 8 can be rotated when collet 10 is released. A servo motor 13 and a coupling mechanism 14 are provided for this; both are attached to the frame 15 of the forming press, and do not move back and forth along with sliding press carriage 3.

Coupling device 14 has the function of establishing the link between servo motor 13 and the spur gear 12. In this connection, device 14 has a drive pinion 16 mounted on a ridged bar 17 which is connected to a drive sleeve 19 surrounding said bar, via a spline 18, such that bar 17 and sleeve 19 cannot rotate relative to each other. Sleeve 19 is rotatably mounted in coupling housing 22 via roller bearings 20 and 21, and on the end opposite driven pinion 16 it is in the form of a drive gear 23 which engages motor pinion 24 which is screwed onto servo motor 13.

Bar 17 is surrounded by compression spring 25 in the interior of drive sleeve 19 which braces against drive sleeve 19 on one end (of the spring) and against the ridged part of bar 17 on the other, thus tending to draw bar 17 into drive sleeve 19. When drawn in in this way, drive pinion 16, as shown in FIG. 1, is outside the reach of spur gear 12 mounted on screw 8, whence there is no hazard of collision as sliding press carriage 3 moves back and forth.

In order to be able to slide drive pinion 16 forward into the engagement position (with gear 12), the back side of coupling housing 22 is provided with housing cover 26 in which engaging piston 27 is guided, which piston lies against bar 17, and which piston is associated with, ahead of it, a pressure space 28 which can be supplied with a hydraulic or pneumatic pressurized pressure medium. In this way engaging piston 27 and thus bar 17 and drive pinion 16 can be slid toward the sliding press carriage 3. In this extended "bottom dead center" position drive pinion 16 and spur gear 12 become engaged, so that the rotational motion of servo motor 13 is transmitted to screw 8, and adjusting wedge 7 and pressure piece are shifted.

Figure 2:
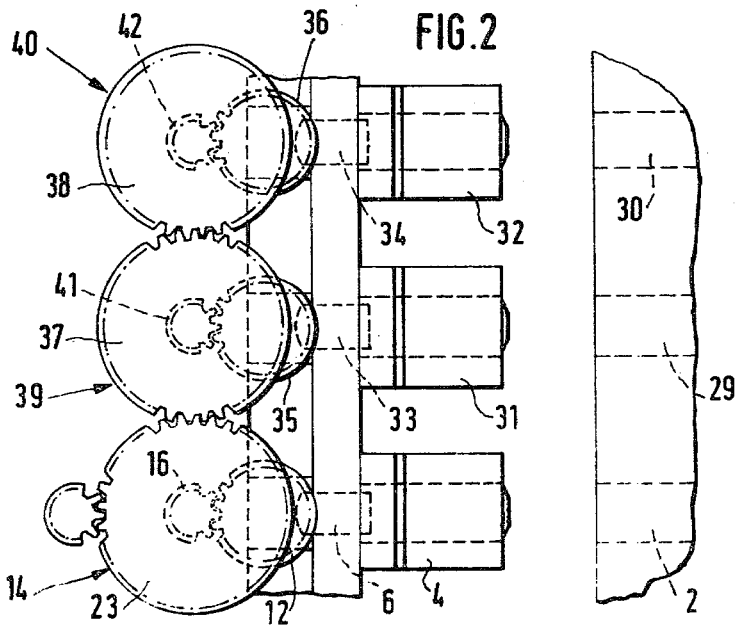
FIG. 2 is a side view of the forming press of FIG. 1.

FIG. 2 shows a side view of the forming press with the three matrices 2, 29 and 30 and the sliding press carriage 3 on which the three plunger blocks 4, 31 and 32 are supported. The pressure pieces 6, 33 and 34 are shown with dotted lines, as are most of the view of spur gears 12, 35 and 36 which are mounted on screws not shown. They (i.e. the greater part of the spur gears) are hidden by the drive gears 23, 37 and 38 of the respective coupling mechanisms 14, 39 and 40, just as the drive pinions 16, 41 and 42 (also shown with dotted lines) are also hidden.

Drive gears 23, 37 and 38 mutually engage, so that only one servo motor 13 is needed to adjust pressure pieces 6, 33 and 34, with the motor pinion 24 of that motor engaging the lowest of the three drive gears 23.

Further, the servo motor 13 may be connected to a remote control device, whereby the setting of the system can be controlled and monitored from a control panel.

We claim:

1. In a forming press having a press frame, at least one tool couple comprising a plunger and a matrix, and a slidable press carriage, the improvement comprising a pressure member movable in the direction of motion of the press carriage for bracing said plunger against said press carriage, screw controlled adjustment means including a motor mounted on said press frame for driving the screw of said adjustment means and thereby positioning said pressure member, a drive gear mounted on said screw, and coupling means for connecting said motor and said drive gear at a predetermined position of said press carriage.

2. A forming press according to claim 1 and wherein said coupling means (14) comprises a pinion (16) connected to said motor (13), said pinion being movable into the path of the sliding press carriage (3) for engaging said driven gear.

3. A forming press according to claim 2 and wherein said pinion (16) is movable into the engaging position by a control piston (27) which operates against the force of a spring (25).

4. A forming press according to claim 2 and wherein said pinion (16) is attached to a bar (17) mounted within a drive sleeve (19), said bar being connected to said drive sleeve via a spline (18) such that said connection is rotationally rigid.

5. A forming press according to one of claims 2 through 4 and wherein said coupling mechanism (14) is disposed on the press frame (15) such that the engaging position occurs at the rearward end of the excursion of the sliding press carriage (3).

6. A forming press according to claims 1, 2, 3 or 4 characterized in that the motor comprises a servo motor (13).

7. A forming press according to claims 1, 2, 3 or 4 and including multiple tool couples (1), an adjusting mechanism and a coupling mechanism for each plunger (5), and said coupling mechanisms (14, 39, 40) being coupled to each other and to said motor (13) by means of gears (23, 37 and 38).

8. In a forming press having a press frame, a slidable press carriage, and at least one tool couple comprising a plunger and a matrix, the improvement comprising a pressure member movable in the direction of motion of the press carriage for bracing the plunger against the press carriage, screw controlled adjustment means for said pressure means, gear means mounted on said screw for rotation therewith, and rotary motor means mounted on the frame for rotating said gear and said screw and thereby positioning said pressure means and plunger by continuous rotation of said motor until a desired completed setting is achieved.

* * * * *